US008906232B2

(12) United States Patent
McInnis

(10) Patent No.: US 8,906,232 B2
(45) Date of Patent: Dec. 9, 2014

(54) DEFORMABLE SUMP INSERT

(76) Inventor: Jeff McInnis, Tacoma, WA (US)

( * ) Notice: Subject to any disclaimer, the term of this patent is extended or adjusted under 35 U.S.C. 154(b) by 552 days.

(21) Appl. No.: 13/102,773

(22) Filed: May 6, 2011

(65) Prior Publication Data

US 2011/0278237 A1 Nov. 17, 2011

Related U.S. Application Data

(60) Provisional application No. 61/334,121, filed on May 12, 2010, provisional application No. 61/359,777, filed on Jun. 29, 2010.

(51) Int. Cl.
*E03F 5/14* (2006.01)

(52) U.S. Cl.
USPC ..... 210/163; 210/170.03; 210/237

(58) Field of Classification Search
None
See application file for complete search history.

(56) References Cited

U.S. PATENT DOCUMENTS

| | | | | | |
|---|---|---|---|---|---|
| 122,209 | A | * | 12/1871 | Ashman | 210/163 |
| 232,948 | A | * | 10/1880 | Dernham | 210/318 |
| 530,816 | A | * | 12/1894 | Wright | 210/247 |
| 809,201 | A | * | 1/1906 | Lutz | 210/314 |
| 1,041,887 | A | * | 10/1912 | Schodde | 210/163 |
| 1,728,381 | A | * | 9/1929 | Waters | 99/319 |
| 1,746,121 | A | * | 2/1930 | Adolph | 210/237 |
| 1,844,872 | A | * | 2/1932 | Shipman | 383/23 |
| 2,102,310 | A | * | 12/1937 | Egan | 210/497.3 |
| 2,263,259 | A | * | 11/1941 | Boosey | 210/314 |
| 2,414,487 | A | * | 1/1947 | Schuttler | 210/359 |
| 2,615,526 | A | * | 10/1952 | Lane | 210/164 |
| 3,282,430 | A | * | 11/1966 | Kinne | 210/162 |
| 4,143,480 | A | * | 3/1979 | Bott | 43/105 |
| 4,419,232 | A | * | 12/1983 | Arntyr et al. | 210/164 |
| 4,871,454 | A | * | 10/1989 | Lott | 210/205 |
| 5,069,781 | A | * | 12/1991 | Wilkes | 210/164 |
| 5,284,580 | A | * | 2/1994 | Shyh | 210/163 |
| 5,372,714 | A | * | 12/1994 | Logue, Jr. | 210/164 |
| 5,397,464 | A | * | 3/1995 | Hannon | 210/163 |
| 5,405,539 | A | * | 4/1995 | Schneider | 210/747.3 |
| 5,575,925 | A | * | 11/1996 | Logue, Jr. | 210/747.3 |
| 5,632,889 | A | * | 5/1997 | Tharp | 210/165 |
| 5,980,740 | A | * | 11/1999 | Harms et al. | 210/162 |
| 6,059,966 | A | * | 5/2000 | Brandhofer et al. | 210/232 |
| 6,086,758 | A | * | 7/2000 | Schilling et al. | 210/164 |
| 6,105,305 | A | * | 8/2000 | Edens | 43/54.1 |
| 6,106,706 | A | * | 8/2000 | Roy et al. | 210/99 |
| 6,106,707 | A | * | 8/2000 | Morris et al. | 210/163 |
| 6,178,565 | B1 | * | 1/2001 | Franco | 4/291 |
| 6,214,216 | B1 | * | 4/2001 | Isaacson | 210/162 |
| 6,241,388 | B1 | * | 6/2001 | Terramani | 383/22 |
| 6,254,770 | B1 | * | 7/2001 | Remon | 210/163 |
| 6,261,444 | B1 | * | 7/2001 | Forse | 210/163 |
| 6,270,663 | B1 | * | 8/2001 | Happel | 210/163 |

(Continued)

*Primary Examiner* — Robert James Popovics
(74) *Attorney, Agent, or Firm* — Æ ON Law; Adam L. K. Philipp

(57) ABSTRACT

A flexible, water-permeable filter basket may be used to collect and remove debris from a sump in a drain-entry structure (e.g., a catch-basin). The filter basket includes a basket floor having a perimeter of substantially the same size and shape as a sump floor, at least one basket sidewall corresponding to at least one sump sidewall, and one or more handles collectively affixed to the at least one basket sidewall, the at least one basket sidewall collectively including a resilient frame. The filter basket may be used as a deformable sump insert to collect debris falling into a drain-entry structure for removal without use of a vactor truck.

18 Claims, 8 Drawing Sheets

(56) References Cited

U.S. PATENT DOCUMENTS

| | | | | |
|---|---|---|---|---|
| 6,274,036 | B1 * | 8/2001 | Ellis | 210/164 |
| 6,294,095 | B1 * | 9/2001 | Lewis | 210/747.3 |
| 6,517,709 | B1 * | 2/2003 | Cardwell et al. | 210/164 |
| 6,521,122 | B1 * | 2/2003 | Elliot et al. | 210/163 |
| 6,531,059 | B1 * | 3/2003 | Morris et al. | 210/164 |
| 6,537,446 | B1 * | 3/2003 | Sanguinetti | 210/163 |
| 6,551,023 | B2 * | 4/2003 | Allard | 405/36 |
| 6,554,997 | B1 * | 4/2003 | Schilling et al. | 210/164 |
| 6,562,233 | B1 * | 5/2003 | Schilling et al. | 210/164 |
| 6,666,974 | B2 * | 12/2003 | Page | 210/747.3 |
| 6,668,390 | B1 * | 12/2003 | Gonzalez | 4/291 |
| 6,712,976 | B2 * | 3/2004 | Manzone | 210/668 |
| 6,824,677 | B2 * | 11/2004 | Martinez | 210/97 |
| 6,872,029 | B2 * | 3/2005 | Allard et al. | 405/36 |
| 6,884,343 | B2 * | 4/2005 | Harris et al. | 210/163 |
| 6,986,621 | B2 * | 1/2006 | Allard | 405/36 |
| 6,998,039 | B2 * | 2/2006 | Harris et al. | 210/164 |
| 7,094,338 | B2 * | 8/2006 | Morris et al. | 210/163 |
| 7,112,274 | B1 * | 9/2006 | Sanguinetti | 210/163 |
| 7,125,823 | B2 * | 10/2006 | Manzone | 502/402 |
| 7,128,832 | B2 * | 10/2006 | Wade | 210/155 |
| 7,156,987 | B1 * | 1/2007 | Sanguinetti | 210/164 |
| 7,186,333 | B2 * | 3/2007 | Kluge | 210/164 |
| 7,201,843 | B2 * | 4/2007 | Sasaki et al. | 210/164 |
| 7,229,559 | B2 * | 6/2007 | Manzone | 210/660 |
| 7,438,803 | B1 * | 10/2008 | Allen | 210/171 |
| 7,524,414 | B1 * | 4/2009 | Barragan | 210/163 |
| 7,658,857 | B2 * | 2/2010 | Wacome | 210/747.3 |
| 7,771,591 | B2 * | 8/2010 | Lucas | 210/163 |
| 7,959,799 | B2 * | 6/2011 | Happel et al. | 210/163 |
| 7,981,300 | B2 * | 7/2011 | Wacome | 210/747.3 |
| 7,988,870 | B2 * | 8/2011 | Belasco | 210/801 |
| 8,221,632 | B2 * | 7/2012 | McInnis et al. | 210/747.3 |
| 8,226,824 | B2 * | 7/2012 | Mondschein et al. | 210/131 |
| 8,608,956 | B2 * | 12/2013 | Moulton et al. | 210/163 |
| 8,652,323 | B2 * | 2/2014 | Dorsey | 210/164 |
| 8,679,329 | B2 * | 3/2014 | Vreeland | 210/164 |
| 2002/0020658 | A1 * | 2/2002 | Isaacson | 210/162 |
| 2002/0048490 | A1 * | 4/2002 | Allard et al. | 405/43 |
| 2002/0096461 | A1 * | 7/2002 | Harris et al. | 210/162 |
| 2002/0104789 | A1 * | 8/2002 | Harris et al. | 210/162 |
| 2002/0113025 | A1 * | 8/2002 | Gauldin et al. | 210/767 |
| 2003/0047497 | A1 * | 3/2003 | Harris et al. | 210/163 |
| 2003/0047514 | A1 * | 3/2003 | Manzone | 210/691 |
| 2003/0098267 | A1 * | 5/2003 | Page | 210/164 |
| 2003/0127380 | A1 * | 7/2003 | Morris et al. | 210/164 |
| 2004/0011731 | A1 * | 1/2004 | Sanguinetti | 210/483 |
| 2004/0016692 | A1 * | 1/2004 | Sasaki et al. | 210/473 |
| 2004/0040901 | A1 * | 3/2004 | Page | 210/163 |
| 2004/0065601 | A1 * | 4/2004 | Martinez | 210/97 |
| 2004/0232057 | A1 * | 11/2004 | Orozco et al. | 210/86 |
| 2005/0067338 | A1 * | 3/2005 | Page | 210/164 |
| 2005/0199537 | A1 * | 9/2005 | Kluge | 210/164 |
| 2005/0230317 | A1 * | 10/2005 | Belasco et al. | 210/691 |
| 2005/0247612 | A1 * | 11/2005 | Glassheim | 210/163 |
| 2006/0049085 | A1 * | 3/2006 | Parker | 210/163 |
| 2008/0023382 | A1 * | 1/2008 | Longo et al. | 210/164 |
| 2008/0179229 | A1 * | 7/2008 | Dorsey | 210/163 |
| 2008/0251470 | A1 * | 10/2008 | Kent | 210/791 |
| 2008/0277335 | A1 * | 11/2008 | Allen | 210/521 |
| 2008/0290042 | A1 * | 11/2008 | Hanson et al. | 210/747 |
| 2009/0101553 | A1 * | 4/2009 | Lucas | 210/164 |
| 2009/0173699 | A1 * | 7/2009 | Wacome | 210/747 |
| 2010/0133201 | A1 * | 6/2010 | Wacome | 210/747 |
| 2011/0278237 | A1 * | 11/2011 | McInnis | 210/767 |
| 2012/0074048 | A1 * | 3/2012 | Glassheim | 210/165 |
| 2012/0145612 | A1 * | 6/2012 | McInnis et al. | 210/163 |
| 2013/0008851 | A1 * | 1/2013 | Jarvis et al. | 210/499 |
| 2013/0020242 | A1 * | 1/2013 | Vreeland | 210/163 |
| 2013/0056399 | A1 * | 3/2013 | Downare | 210/170.03 |
| 2013/0118963 | A1 * | 5/2013 | Bailey et al. | 210/164 |
| 2013/0186811 | A1 * | 7/2013 | Kaiser | 210/163 |
| 2013/0299402 | A1 * | 11/2013 | Rogahn | 210/163 |
| 2014/0027362 | A1 * | 1/2014 | Kent | 210/170.03 |
| 2014/0238915 | A1 * | 8/2014 | McInnis et al. | 210/170.03 |

* cited by examiner

DEFORMABLE SUMP INSERT

CROSS-REFERENCE TO RELATED APPLICATIONS

This application claims the benefit of priority to U.S. Provisional Application No. 61/334,121, filed May 12, 2010, titled "CATCH-BASIN INSERT," and naming inventor Jeff McInnis. This application also claims the benefit of priority to U.S. Provisional Application No. 61/359,777, filed Jun. 29, 2010, titled "CATCH-BASIN INSERT," and naming inventor Jeff McInnis. The above-cited applications are incorporated herein by reference in their entireties, for all purposes.

FIELD

This application is directed to storm-drain maintenance devices, and more particularly, to a sump insert.

BACKGROUND

Storm drain systems are designed to drain excess rain and ground water from paved streets, parking lots, sidewalks, roofs, and the like. Excess rain and ground water typically enter a storm drain system via a drain-entry structure such as a catchbasin, manhole, or the like. The two most common types of catchbasins use either top inlets or side inlets (typically located adjacent to a curb). Manhole structures, which are typically larger than catchbasins, typically use a top inlet. In any case, the dimensions of the inlet opening are typically smaller than the dimensions of the bottom of the catchbasin, manhole, or other drain-entry structure directly below.

FIG. 1 illustrates a top-inlet-type drain entry structure 100 with a removable grating or grid 105 (shown removed to expose inlet opening 140 for maintenance). Top-inlet gratings (e.g. grating 105) are typically intended to prevent large objects and debris from entering the sewer system. However, their bars are typically fairly widely spaced so that the flow of water is not impeded. Consequently, many small pieces of debris 115, often including sand, silt, leaves, mud, rocks, small objects, and the like, are allowed to pass through top-inlet grating 105. As illustrated in FIG. 1, many of these small pieces of debris 115 are caught by sump 110 (also referred to as a "catch"), which lies directly below the grating. Side inlet catchbasins also allow small pieces of debris to collect in a sump.

Water 125 from the top of the sump 110 drains into the sewer proper (not shown) via outlet pipe 120. Most modern sumps extend at least a foot 135 below the bottom of outlet pipe 120. Some older sumps may extend as little as two inches below the bottom of outlet pipe 120.

Drain-entry structures generally require routine maintenance to remove accumulated debris 115 from the sump 110. Indeed, many jurisdictions mandate that landowners perform periodic storm drain maintenance. Many municipalities have large vacuum or "vactor" trucks that perform this task with a large vacuum hose 130 that sucks debris 115 from the sump 110 via inlet opening 140. Some private landowners may engage the services of a private vacuum truck to maintain drain-entry structures on their property, while other private landowners may have debris manually removed from drain-entry structures on their property such as with a shovel.

However, vacuum trucks are expensive to operate and/or engage, while manual drain-entry structure maintenance can be difficult and/or awkward, as many drain-entry structures are relatively deep and/or narrow, which makes it difficult to efficiently remove debris 115 with a manual shovel. Furthermore, many drain-entry structures (especially side-inlet and top-inlet catchbasins) have relatively small inlet openings (e.g. opening 140) that further hamper manual debris removal with a shovel.

DESCRIPTION

The phrases "in one embodiment," "in various embodiments," "in some embodiments," and the like are used repeatedly. Such phrases do not necessarily refer to the same embodiment. The terms "comprising," "having," and "including" are synonymous, unless the context dictates otherwise.

Figure 2:
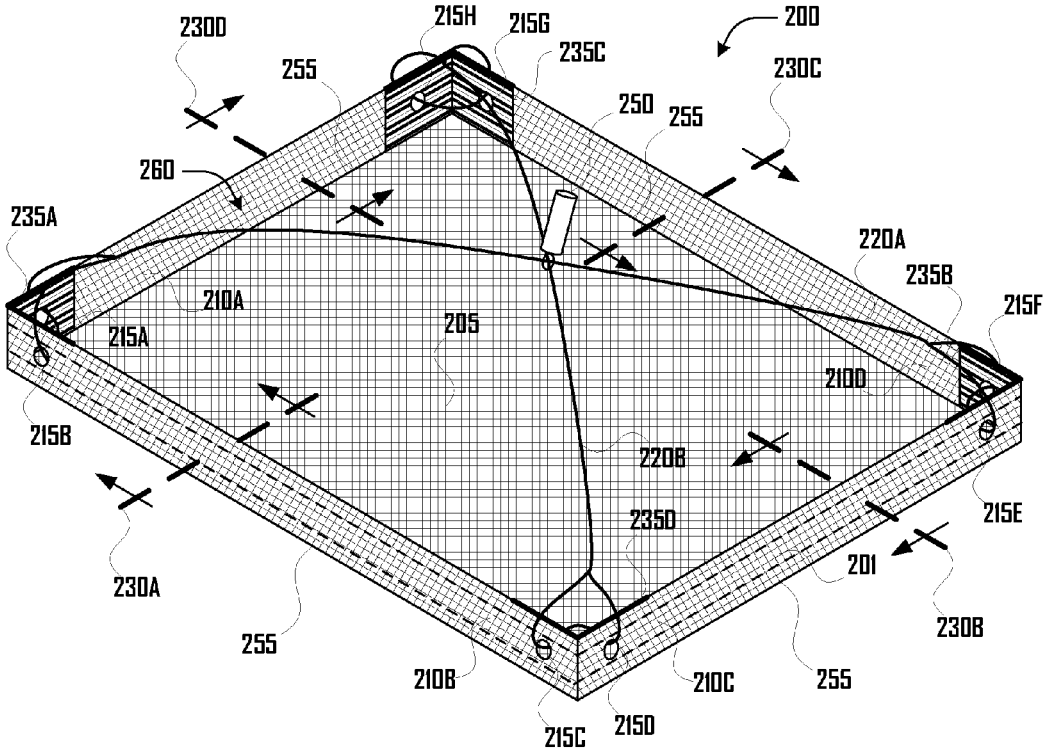
FIGS. 2-4 illustrate a sump insert in accordance with one embodiment.
Figure 4:
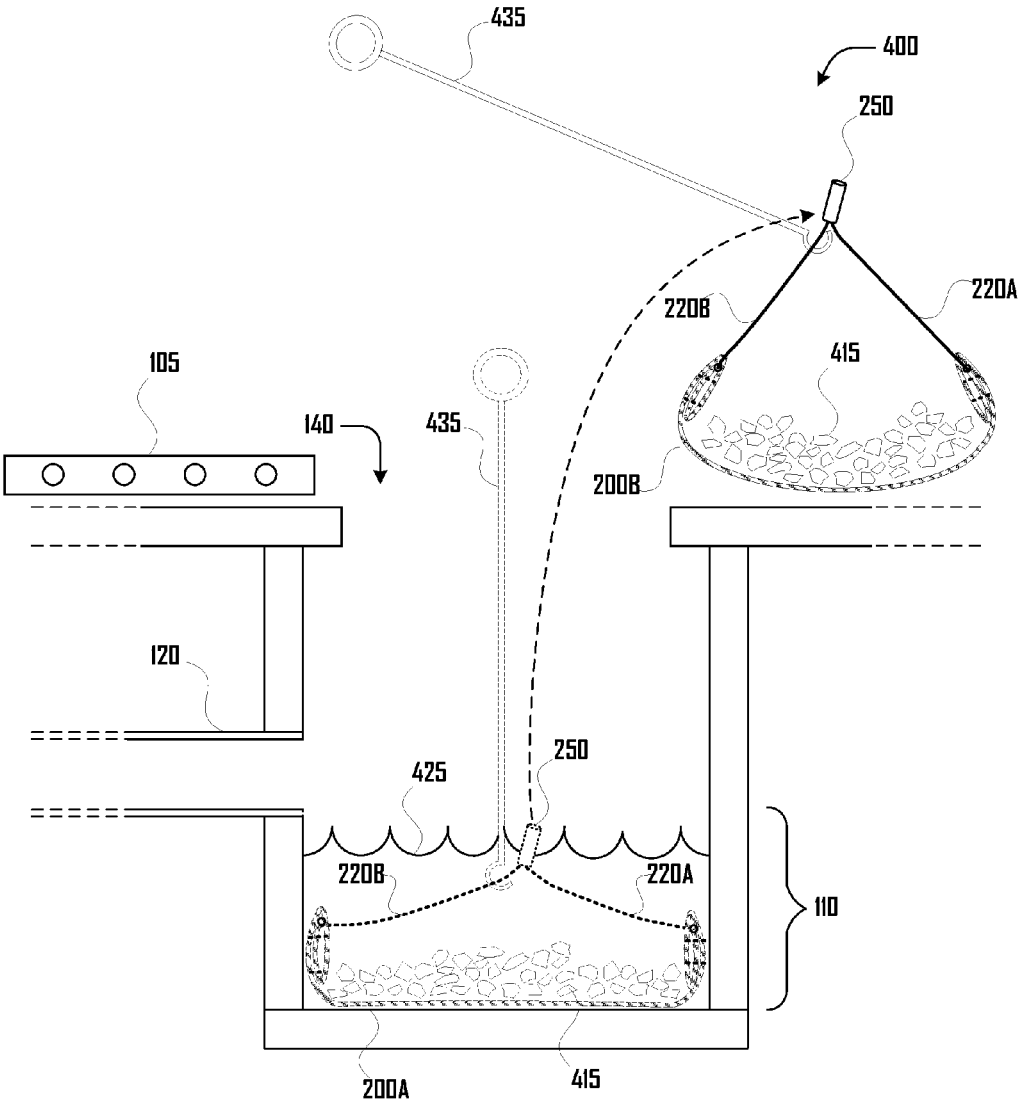

FIG. 2 illustrates a deformable sump insert 200 for capturing and facilitating removal of debris from a drain-entry structure in accordance with one embodiment. FIG. 4 illustrates such a sump insert 200 employed in connection with a sump 110 within a drain-entry structure (e.g., a catchbasin, manhole, or the like). As illustrated in FIG. 4, sump insert 200A resides in sump 110 entirely below outlet pipe 120, and accumulates debris 415 entering through inlet opening 140. Sump insert 200A is further configured to be capturable via a capture device 435 (here, a pole-mounted hook) and removed through inlet opening 140 in a flexed position, such that removed sump insert 200B retaining most or all of the accumulated debris 415 for disposal. For example, once the sump insert 200 has been captured and removed from the sump 110 through the inlet opening 140, the accumulated debris 415 may be dumped, scooped, shoveled, or otherwise transferred into a container (not shown). In some embodiments, a portable "shop-vac" type vacuum (not shown) may be used to collect and dispose of the accumulated debris 415.

Referring again to FIG. 2, sump insert 200 takes the form of a filter "basket" structure 201 including a basket floor 205 and four basket sidewalls 210A-D, which are disposed about the perimeter 255 of basket floor 205 to form an upper basket opening 260. In various embodiments, floor 205 and sidewalls 210A-D are made from a textile material that is water-permeable, flexible, and puncture-resistant; has high tensile strength and low elasticity; and resists breaking down in a wet environment. In addition, in many embodiments, floor 205 and sidewalls 210A-D are made from a textile material that is non-buoyant when inundated with water so that sump insert 200 is less likely to enter (and possibly obstruct) outlet pipe 120 when sump 110 is full of water (see FIG. 4). In some embodiments, a nonwoven geotextile fabric may be a suitable material for floor 205 and sidewalls 210A-D. In some embodiments, a nonwoven geotextile fabric or similar filtering material may be layered over a floor 205 and/or sidewalls 210A-D of a durable, hydroconductive material. (See FIGS.

5-6, discussed below.) In some embodiments, portions of floor 205 and/or sidewalls 210A-D may be optionally reinforced with a reinforcing material (e.g., 235A-C), such as high-density polyethylene ("HDPE") or other suitable material.

In many embodiments, the dimensions of floor 205, at its perimeter 255, are approximately the same as the dimensions of the sump floor of a standard drain-entry structure type. For example, many standard-sized catchbasins in the state of Washington have a rectangular sump floor approximately 22 in by 26 in. Accordingly, in some embodiments, the perimeter 255 of floor 205 may also be rectangular and approximately 22 in by 26 in. Other jurisdictions may have different standards for drain-entry structure sizes, and other drain-entry structure types (e.g., manholes) may also have different sizes. Accordingly, other embodiments may be configured to fit other shapes and/or sizes of drain-entry structure.

In various embodiments, sidewalls 210A-D are configured to be short enough not to obstruct and/or interfere with a storm sewer outlet pipe (e.g., outlet pipe 120, as illustrated in FIG. 4), yet tall enough to facilitate retaining most or all accumulated debris when sump insert 200 is drawn up and out of a drain-entry structure in a flexes position (see FIG. 4). In one embodiment, sidewalls 210A-D may be no taller than is required to facilitate retaining an acceptable portion of accumulated debris when sump insert 200 is drawn up and out of a drain-entry structure. In some embodiments, sidewalls 210A-D may be approximately 2-4 in tall. In alternate embodiments (not shown), sidewalls 210A-D may be shorter, or even completely omitted. In other embodiments, sidewalls 210A-D may be taller than 4 in. In some embodiments, some or all of sidewalls 210A-D may have differing and/or non-uniform heights. For example, in one embodiment that may be suitable for use in a side-inlet catchbasin (not shown), a sidewall that is parallel to and most distant from the inlet-side (not shown) of the catchbasin may be taller than the remaining sidewalls to facilitate retaining most or all accumulated debris when the sump insert is drawn out via the side-inlet (not shown).

Figure 3:
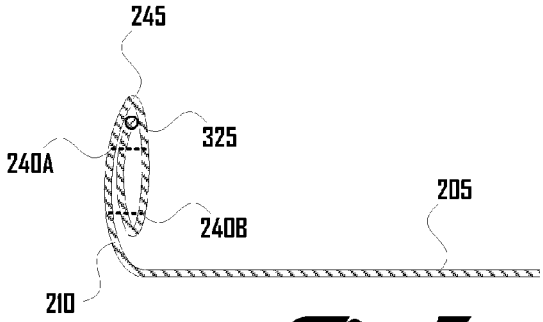

FIG. 3 illustrates a sectional view of sump insert 200, taken from a plane indicated by any of broken lines 230A-D in FIG. 2. As illustrated in FIG. 3, sump insert 200 includes a resilient frame 325 positioned along sidewalls 210. In many embodiments, resilient frame 325 may include several resilient members that may be fixedly or removably positioned at or near the upper portion of sidewalls 210. In various embodiments, resilient frame 325 comprises one or more members composed of an elastically and/or resiliently bendable material. In various embodiments, such resilient frame members may comprise narrow rods, tubes or pipes, thin flat bars, and the like. In one embodiment, resilient frame 325 may include fiberglass rods that are suitably resilient (as discussed below) and that may also be non-buoyant. The exact lengths of resilient members making up resilient frame 325 are not typically critical, but in most embodiments, resilient members of the resilient frame 325 are within 2-3 inches (longer or shorter) of the length of the sidewall along which the resilient member is positioned.

Figure 1:
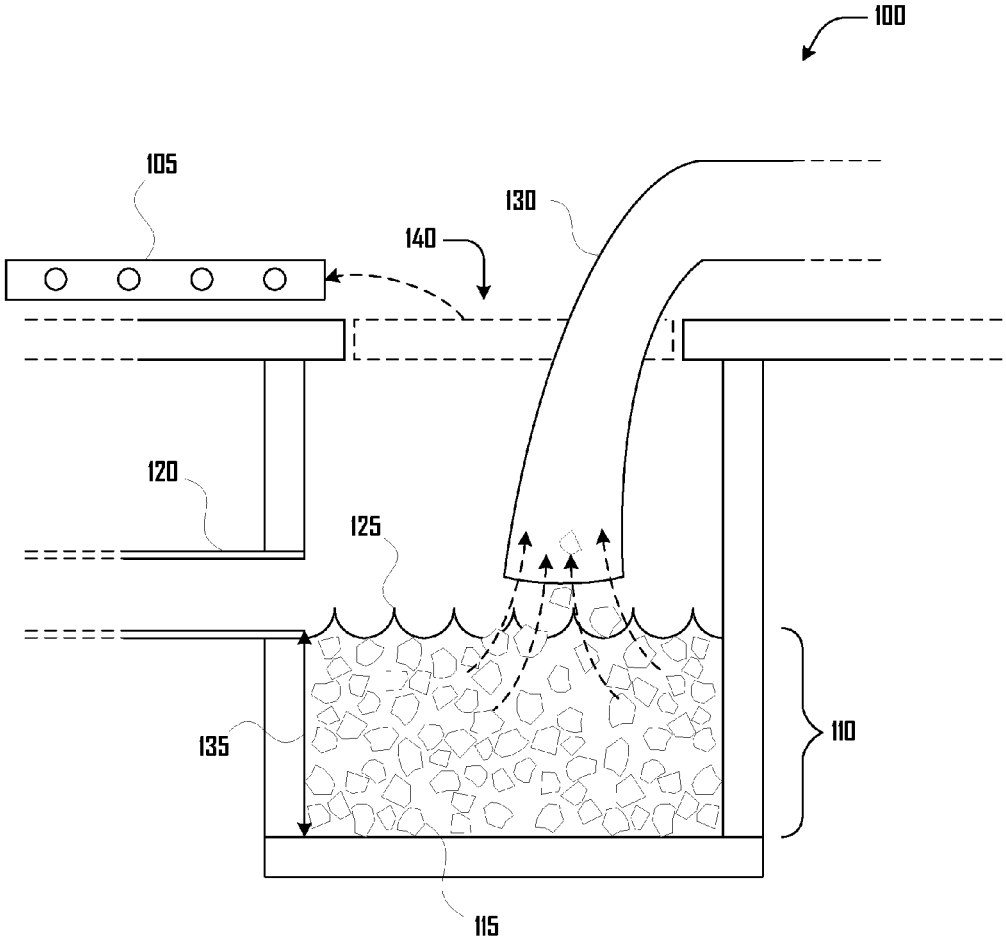
Fig.1 (prior art)
FIG. 1 illustrates a prior art storm drain vacuum maintenance system.

The lengths of resilient members making up resilient frame 325 are determined in light of their bendable elasticity. In various embodiments, resilient members of resilient frame 325 may be sufficiently long and/or resilient that when sump insert 200 is placed on the bottom of sump 110, resilient frame 325 will spring towards opposing sump sidewalls, facilitating floor 205 to cover all or almost all of the sump floor 110. At the same time, members of resilient frame 225 may be sufficiently short and/or bendable that sump insert 200 can be removed through inlet opening 140 while retaining most or all of the debris that has accumulated on floor 205. (As discussed above in relation to FIG. 1, the dimensions of inlet opening 140 are typically smaller than the dimensions of the bottom of sump 110.)

In some embodiments, resilient frame 325 may include several members that each individually comprise two or more suitable rods, tubes or pipes, thin flat bars, and the like. In alternate embodiments, resilient frame 325 may comprise inherent portions of basket floor 205. For example, in one embodiment, basket floor 205 itself may be formed from an elastically and/or resiliently bendable material, enabling basket floor 205 to incorporate resilient frame 325 into its inherent form. In other alternate embodiments, resilient frame 325 may comprise and/or be combined with basket sidewalls 210A-D. For example, in one embodiment, basket sidewalls 210A-D may be formed from an elastically and/or resiliently bendable material, enabling basket sidewalls 210A-D to incorporate resilient frame 325 into their inherent forms.

In one embodiment, resilient frame 225 comprises ¼ inch fiberglass rods disposed within the crease at the folded top edge 245 of the basket sidewall 210. In one embodiment, the folded basket sidewalls are secured with nylon stitching 240A-B.

Referring again to FIG. 2, sump insert 200 also includes handles 220A-B, which are affixed to some or all of basket sidewalls 210A-D and/or basket floor 205 via attachment points 215A-D. In some embodiments, attachment points 215A-D are positioned at or near the corners of basket floor 205 and/or at or near the intersections of basket sidewalls 210A-D. In some embodiments, attachment points 215A-D may comprise through-holes in some or all of sidewalls 210A-D and/or floor 205. In such embodiments, attachment points 215A-D may be reinforced with grommets, stitching, reinforcing material, and/or other suitable reinforcing means. In other embodiments, attachment points 215A-D may comprise other structures (not shown) suitable for affixing handles 220A-B to some or all of basket sidewalls 210A-D and/or basket floor 205.

In many embodiments, handles 220A-B are formed from a flexible, rot-resistant material that is strong enough to carry the weight of sump insert 200 and any debris accumulated thereon (some or all of which may be waterlogged). In various embodiments, handles 220A-B may comprise a linear material such as wire, rope, cord, line, string, twine, straps, chain, webbing, and the like. In one embodiment, handles 220A-B may be formed from nylon rope. In many embodiments, natural-fiber materials may be unsuitable for handles 220A-B. In many embodiments, handles 220A-B may further comprise one or more suitable fasteners (not shown), such as clamps, knots, clips, hooks, loops, rings, buckles, clasps, and the like. In some embodiments, handles 220A and 220B may be affixed to one another at or near their respective center portions with a fastener (e.g., buoyant fastener 250).

In some embodiments, handles 220A-B may comprise resiliently bendable rods, tubes, or the like, in which case handles 220A-B may comprise and/or replace some or all of resilient frame 325. In such embodiments, handles 220A-B may act in a spring-like manner to facilitate positioning basket floor 205 such that basket floor 205 covers all or almost all of the sump floor.

As illustrated in FIG. 4, handles 220A-B are configured to engage capture device 435, facilitating the removal of most or all accumulated debris 415 when sump insert 200 is drawn out of sump 110 in a flexed position through inlet opening 140.

In some embodiments, handles 220A-B may be configured to be at least partially buoyant to facilitate engagement with capture device 435 when sump insert 200 is in place in sump 110, possibly covered by water 425 and/or debris 415. To similarly facilitate engagement with capture device 435, in some embodiments, individual handles 220A and 220B may be affixed to one another at or near their respective center portions with a fastener (e.g. buoyant fastener 250). In some embodiments, such a fastener (e.g. buoyant fastener 250) may be strong enough and configured such that capture device 435 may need to engage only a portion of one of handles 220A or 220B in order to remove sump insert 200 and any accumulated debris from sump 110.

Referring again to FIG. 2, in some embodiments, sump insert 200 may also include one or more weights (not shown) configured to facilitate sump insert 200 remaining positioned on the bottom of sump 110 (e.g., by countering any buoyancy in sump insert 200 and/or any of its components) and covering all or almost all of the sump floor. In various embodiments, such weights may be affixed or removably affixed to some or all of basket sidewalls 210A-D and/or basket floor 205. In other embodiments, weights may be freely positionable on basket floor 205.

In one embodiment, filter basket 201 (including basket floor 205 and basket sidewalls 210A-D) may be constructed (at least in part) from a lightweight water-permeable nonwoven polypropylene geotextile such as Mirafi 140N, provided by Koninklijke Ten Cate nv of The Netherlands.

In one embodiment, handles 220A-B may comprise two pieces of ¼ inch nylon rope, approximately three feet in length, affixed to basket sidewalls 210A-D via through-holes 215A-D reinforced with high-density polyethylene ("HDPE") reinforcing members 235. Reinforcing members 235 may also provide additional structural support and may facilitate the basket sidewalls 210A-D to remain relatively erect when sump insert 200 is positioned on the sump floor within a drain-entry structure. In one embodiment, resilient frame 325 comprises fiberglass rods sewn into basket sidewalls 210A-D with nylon stitching 240A-B.

Figure 5:
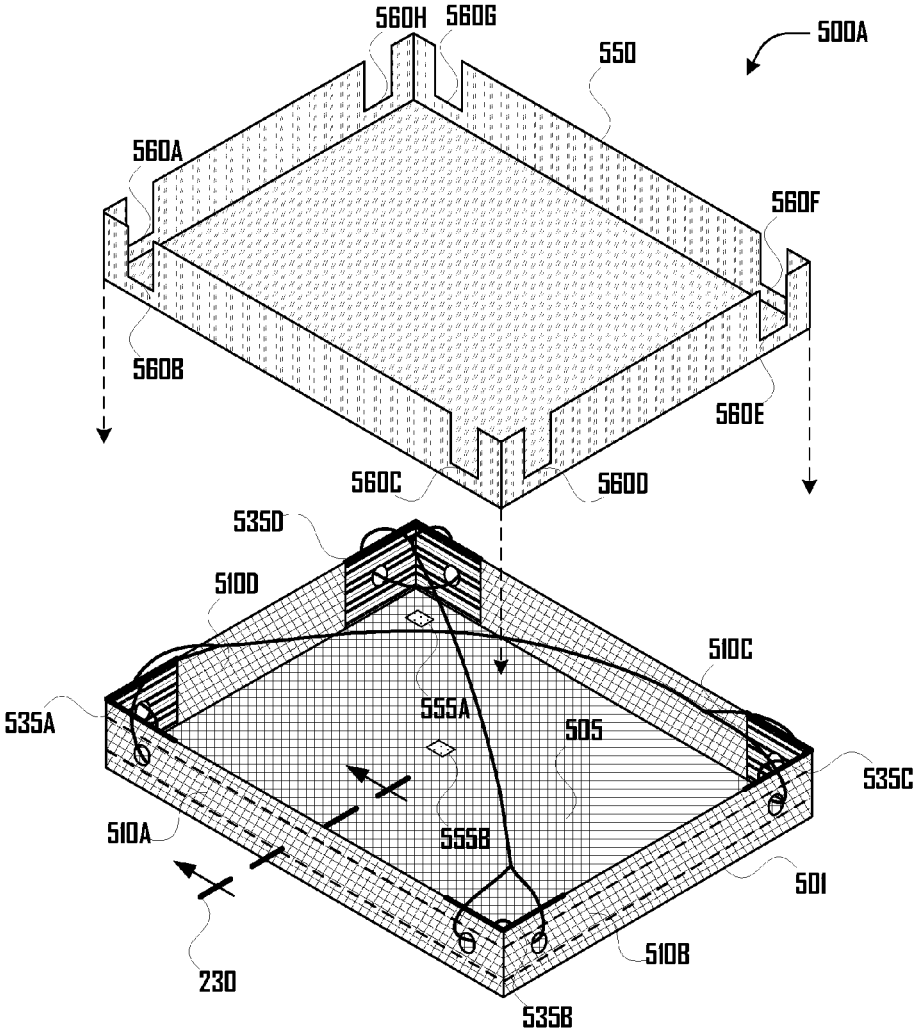
FIGS. 5-6 illustrate a sump insert in accordance with an alternate embodiment.

FIG. 5 illustrates an alternate embodiment of a deformable sump insert 500A, which includes a filter basket 501 and a replaceable filter liner 550. In many respects, sump insert 500A is similar to sump insert 200, and the discussion (above) of many aspects of sump insert 200 are similarly applicable to sump insert 500A, including its dimensions, sidewall configuration, resilient frame (not shown in FIG. 5), handles, reinforcing members, and the like. Moreover, in some embodiments, a cross section similar to that illustrated in FIG. 3, discussed above, may be employed to form appropriate portions of filter basket 501. Furthermore, in various embodiments, sump insert 500A can be identically used in place of sump insert 200 as illustrated in FIG. 4, discussed above. These duplicative aspects of sump insert 500A will not be re-discussed here.

As mentioned above, sump insert 500A differs from sump insert 200 in that sump insert 500A comprises a durable filter basket 501 (including basket sidewalls 510A-D and basket floor 505) and a replaceable filter liner 550, which may be removably affixed to basket floor 505 and/or basket sidewalls 510A-D, such as via fasteners 555A-B. In some embodiments, fasteners 555A-B may comprise hook fastener tape, positioned on the basket floor 505 and/or near the tops of the basket sidewalls 510A-D.

In some embodiments, filter basket 501 (including basket sidewalls 510A-D and basket floor 505) are made from a material that is highly water-permeable or hydroconductive, flexible, and puncture-resistant; has high tensile strength and low elasticity; and resists breaking down in a wet environment. In addition, in many embodiments, basket floor 505 and basket sidewalls 510A-D are made from a material that is non-buoyant when inundated with water. In some embodiments, portions of basket floor 505 and/or basket sidewalls 510A-D may be optionally reinforced with reinforcing members 535A-D. In some embodiments, reinforcing members 535A-D may be constructed from a suitable material such as high-density polyethylene ("HDPE").

In some embodiments, filter basket 501 (including basket sidewalls 510A-D and basket floor 505) may be made from a durable, open weave, self-draining, vinyl-encapsulated mesh fabric, such as Phifertex, provided by PHIFER Incorporated of Tuscaloosa, Ala. In some embodiments, filter basket 501 may be used on its own (with no filter liner) to collect much debris that may fall into the sump. However, such an encapsulated mesh fabric may be too porous or hydroconductive to effectively collect silt and other very small pieces of debris.

Accordingly, in some embodiments, removable filter 550 may be configured to be removably positioned within filter basket 501 such that removable filter 550 may filter silt and other small pieces of debris (in addition to larger pieces of debris). In some embodiments, a nonwoven geotextile fabric (e.g., Mirafi 140N) may be a suitable material for removable filter 550.

In some embodiments, filter liner 550 may include cutouts 560A-H such that filter liner 550 may be removably affixed in filter basket 501 without interference by handle attachment points.

Figure 6:
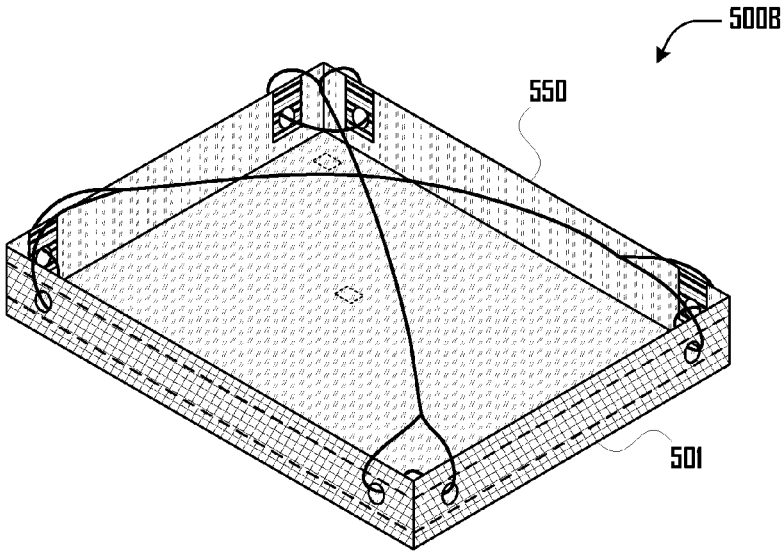

FIG. 6 illustrates sump insert 500B, including replaceable filter liner 550 removably affixed in filter basket 501 to cover basket floor 505 (not shown in FIG. 6). In some embodiments, replaceable filter liner 550 may also includes tabs (not shown) or other means designed to facilitate gripping filter liner 550 for removal from filter basket 501. In one embodiment, filter liner 550 may be constructed (at least in part) from a lightweight water-permeable nonwoven polypropylene geotextile such as Mirafi 140N. In various embodiments, filter liner 550 may be removed to facilitate disposal of any collected debris and/or sediment, and/or to facilitate cleaning of filter liner 550 (if it is to be re-used) and/or filter basket 501. When filter basket 501 has reached the end of its useful life, it may be replaced, and the durable filter basket 501 re-used. In some embodiments, filter basket 501 may be sufficiently durable to outlast a number of filter liners.

Figure 7:
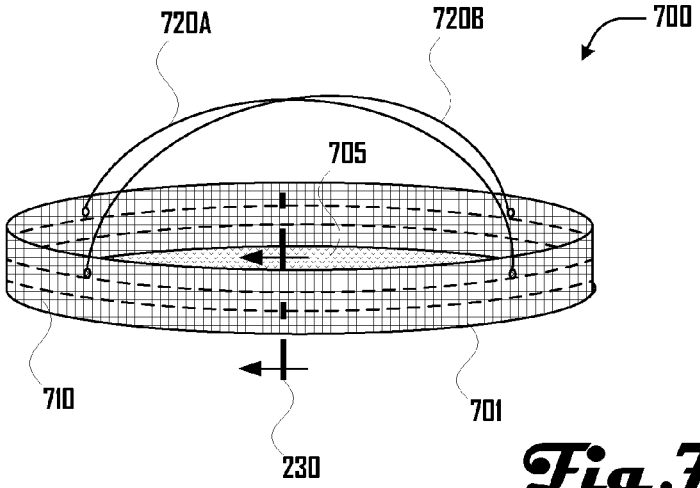
FIG. 7 illustrates a sump insert in accordance with another alternate embodiment.

FIG. 7 illustrates an alternate embodiment of a sump insert 700, designed for use in storm-drain entry structures having a round floor and only a single, cylindrical sump sidewall (e.g., manholes). Sump insert 700 differs from sump insert 200 in that filter floor 705 is circular, and in that sump insert 700 therefore has only a single basket sidewall 710. In other respects, sump insert 700 is similar to sump insert 200, and the discussion (above) of many aspects of sump insert 200 are similarly applicable to sump insert 700A, including the construction of basket floor 705 and basket sidewall 710, its resilient frame (not shown in FIG. 7), handles 720A-B, and the like. Moreover, in some embodiments, a cross section similar to that illustrated in FIG. 3, discussed above, may be employed to form appropriate portions of basket sidewall 710.

In other embodiments, sump insert 700 may be similar (aside from shape and number of basket sidewalls) to sump insert 500, such that filter basket 701 may be employed in connection with a suitably configured replaceable filter liner (not shown).

Figure 8:
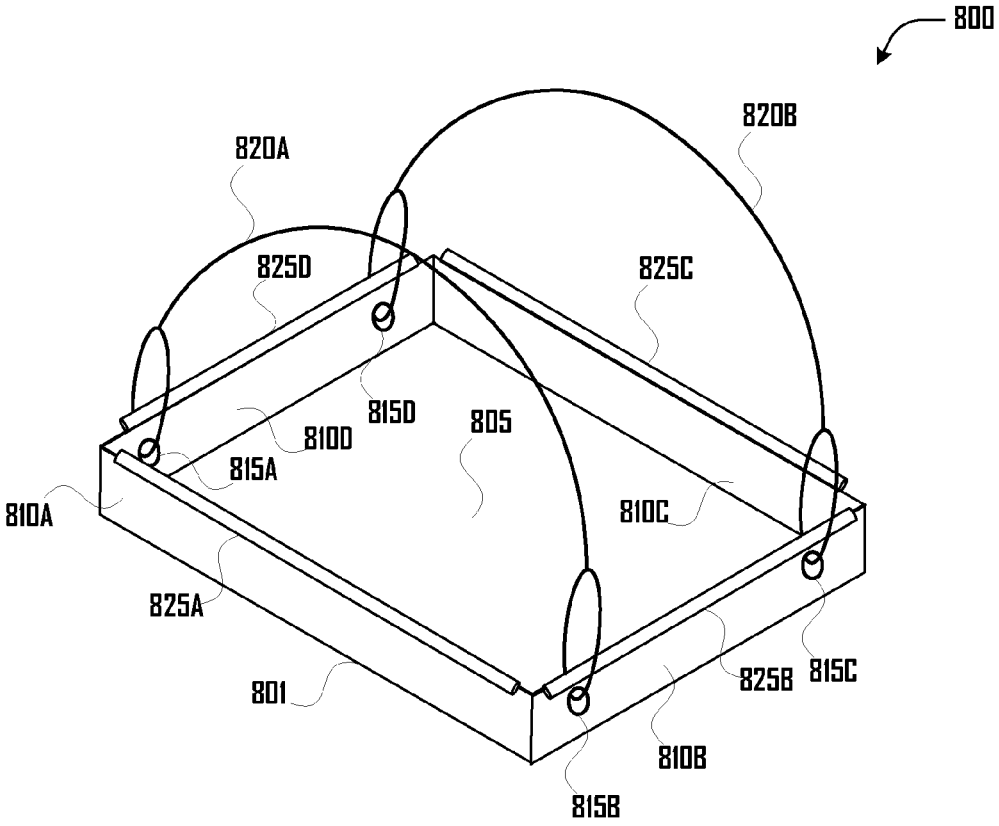
FIG. 8 illustrates a sump insert in accordance with yet another alternate embodiment.

FIG. 8 illustrates a sump insert 800 in accordance with an alternate embodiment. Sump insert 800 differs from sump insert 200 and/or sump insert 500 in the configuration of handles 820A-B and attachment points 815A-D. Moreover, a resilient frame including resilient members 825A-D is positioned in an alternate configuration. In various embodiments, attachment points 815A-D may be positioned along shorter sidewalls 810B and 810D (as shown), and/or along longer sidewalls 810A and 810C (not shown).

In other respects, sump insert 800 is similar to sump insert 200, and the discussion (above) of many aspects of sump insert 200 are similarly applicable to sump insert 800A, including the construction of basket floor 805 and basket sidewall 810, its resilient frame (not shown in FIG. 8), handles 820A-B, and the like. In other embodiments, sump insert 800 may be similar to sump insert 500, such that filter basket 801 may be employed in connection with a suitably configured replaceable filter liner (not shown).

Figure 11:
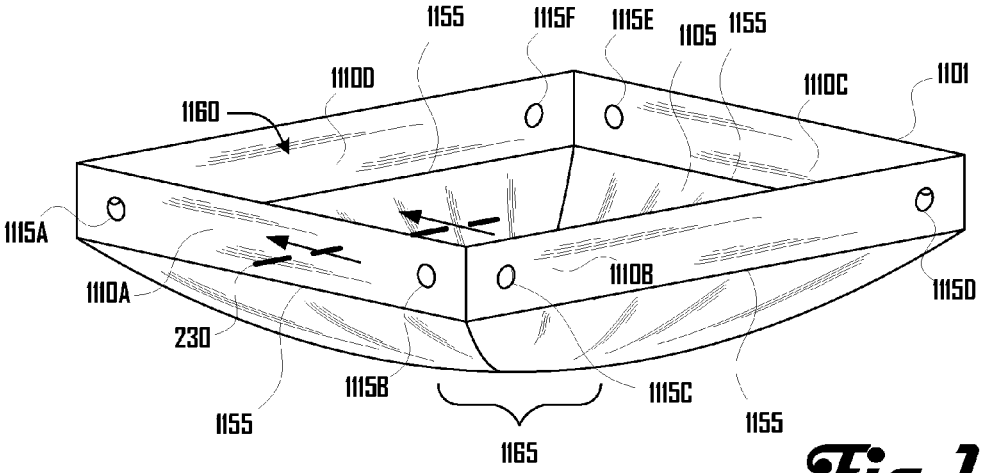
FIG. 11 illustrates a sump insert basket in accordance with an alternate embodiment.

FIG. 11 illustrates a sump insert filter basket 1101 in accordance with an alternate embodiment. Filter basket 1101 differs from filter basket 200 and/or filter basket 501 in that while the perimeter 1155 of basket floor 1105 is rectangular, the interior area of basket floor 1105 (that which is surrounded by the rectangular perimeter) is configured as a shallow, flexible "bag" or concavity (with respect to upper basket opening 1160) whose walls curve towards a central portion 1165 of basket floor 1105. In some embodiments, the depth of the bag or concavity with respect to the perimeter 1155 of basket floor 1105 may be approximately 3-6 inches. Such a configuration may enhance filter basket 1101's effectiveness at collecting and containing debris. Further, such a configuration may allow floor 1105 to conform to sump floors that have an irregular surface.

In other respects, filter basket 1101 is similar to filter basket 201, and the discussion (above) of many aspects of filter basket 201 are similarly applicable to sump insert 1101, including the construction of basket sidewalls 1110A-D, resilient frame (not shown in FIG. 11), handles (not shown), handle attachment points 1115A-F, and the like. In other embodiments, filter basket 1101 may be similar to filter basket 501, such that filter basket 1101 may be employed in connection with a suitably configured replaceable filter liner (not shown). In other respects, sump insert 700 is similar to sump insert 200, and the discussion (above) of many aspects of sump insert 200 are similarly applicable to sump insert 700A, including the construction of basket floor 705 and basket sidewall 710, its resilient frame (not shown in FIG. 7), handles 720A-B, and the like. Moreover, in some embodiments, a cross section similar to that illustrated in FIG. 3, discussed above, may be employed to form appropriate portions of basket sidewalls 1110A-D.

Figure 9:
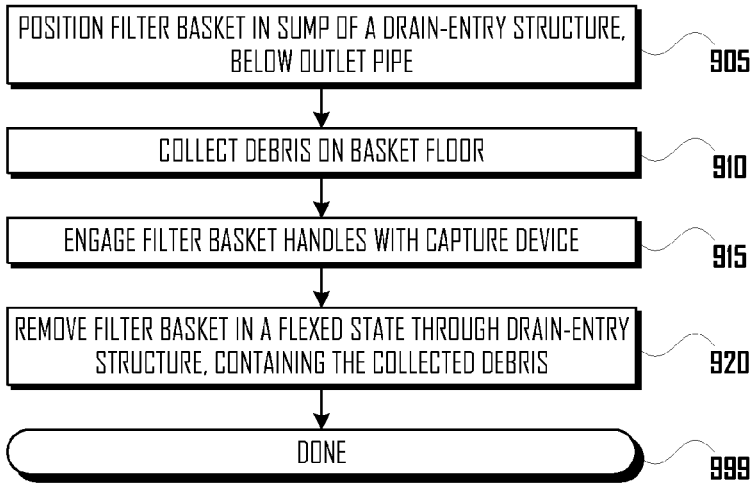
FIGS. 9-10 illustrate methods for removing debris from a storm-drain entry structure, in accordance with various embodiments.

FIG. 9 illustrates a routine 900 for removing debris from a storm-drain entry structure having an inlet opening, an outlet pipe, and a sump below the outlet, the sump having a sump floor and at least one sump sidewall, the inlet opening being smaller than the sump floor.

In block 905, a flexible, water-permeable filter basket is positioned in the sump, entirely below the outlet pipe. The filter basket comprises a basket floor having a perimeter of substantially the same size and shape as the sump floor, at least one basket sidewall corresponding to the at least one sump sidewall, and one or more handles collectively affixed to the at least one basket sidewall, the at least one basket sidewall collectively including a resilient frame. In positioning the filter basket in the sump, the resilient frame is positioned along the at least one sump sidewall such that the basket floor and at least one basket sidewall are positioned to collect debris falling through an upper basket opening (formed by the basket sidewalls).

In some embodiments, a float may be affixed near one or more center portions of the one or more handles.

In block 910, debris is allowed to fall into the sump and collect on the basket floor.

In block 915, the one or more handles are engaged with a capture device inserted through the inlet opening. If a float has been affixed to the one or more handles, engaging the handles with the capture device may include visually identifying a location of the float near a top surface of a volume of water (the volume of water filling at least a portion of the sump and submerging the filter basket) and locating the one or more handles with the capture device below the surface of the water based at least in part on the location of the float.

In block 920, the filter basket is removed through the inlet opening with the capture device via the one or more handles, such that as the filter basket is drawn out of the sump, the resilient frame flexes to substantially contain the collected debris within the basket floor and the at least one basket sidewall.

Routine 900 ends in block 999.

Figure 10:
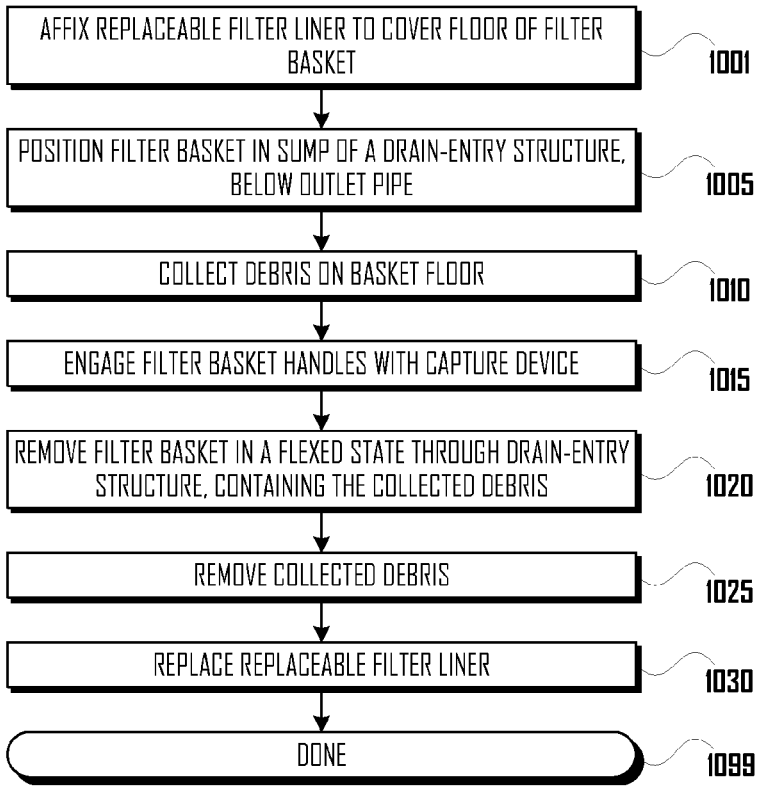

FIG. 10 illustrates a routine 1000 for removing debris from a storm-drain entry structure having an inlet opening, an outlet pipe, and a sump below the outlet, the sump having a sump floor and at least one sump sidewall, the inlet opening being smaller than the sump floor.

In block 1001, a replaceable filter liner is removably positioned to cover the basket floor of a flexible, water-permeable filter basket. The filter basket comprises a basket floor having a perimeter of substantially the same size and shape as the sump floor, at least one basket sidewall corresponding to the at least one sump sidewall, and one or more handles collectively affixed to the at least one basket sidewall, the at least one basket sidewall collectively including a resilient frame.

In block 1005, a flexible, water-permeable filter basket is positioned in the sump, entirely below the outlet pipe. In positioning the filter basket in the sump, the resilient frame is positioned along the at least one sump sidewall such that the basket floor and at least one basket sidewall are positioned to collect debris falling into the sump.

In some embodiments, a float may be affixed near one or more center portions of the one or more handles.

In block 1010, debris is allowed to fall into the sump and collect on the basket floor.

In block 1015, the one or more handles are engaged with a capture device inserted through the inlet opening. If a float has been affixed to the one or more handles, engaging the handles with the capture device may include visually identifying a location of the float near a top surface of a volume of water (the volume of water filling at least a portion of the sump and submerging the filter basket) and locating the one or more handles with the capture device below the surface of the water based at least in part on the location of the float.

In block 1020, the filter basket is removed through the inlet opening with the capture device via the one or more handles, such that as the filter basket is drawn out of the sump, the resilient frame flexes to substantially contain the collected debris within the basket floor and the at least one basket sidewall.

In block 1025, the collected debris is removed from the basket floor and the replaceable filter liner. If the filter liner is not to be re-used, then in block 1030, the replaceable filter liner is removed from the basket floor, and a replacement filter liner is removably affixed to the basket floor prior to repositioning the filter basket in the sump.

Routine 1000 ends in block 1099.

Although specific embodiments have been illustrated and described herein, it will be appreciated by those of ordinary skill in the art that a whole variety of alternate and/or equivalent implementations may be substituted for the specific embodiments shown and described without departing from the scope of the present disclosure. For example, although FIG. 4 illustrates sump insert 200 used in connection with a top-inlet drain-entry structure (e.g., a catchbasin, manhole, or the like), various embodiments of sump insert 200 may be also be employed to remove debris from side inlet catchbasins, possibly employing a suitably curved and/or angled capture device (not shown). This application is intended to cover any adaptations or variations of the embodiments discussed herein.

The invention claimed is:

1. A deformable sump insert for use with a storm-drain entry structure having an inlet opening, an outlet pipe, and a sump below the outlet pipe, the sump having a sump floor and at least one sump sidewall, the inlet opening being smaller than the sump floor, the sump insert comprising:

a flexible, water-permeable filter basket positioned in the sump, entirely below the outlet pipe, the basket comprising:

a basket floor having a perimeter that is substantially the same size and shape as the sump floor, and that is larger than the inlet opening; and at least one basket sidewall corresponding to the at least one sump sidewall, the at least one basket sidewall being disposed about the perimeter of the basket floor to form an upper basket opening, the at least one basket sidewall collectively including a resilient frame that is positionable along the at least one sump sidewall such that when the basket is positioned in the sump, the basket floor and at least one basket sidewall are positioned to collect debris falling through the upper basket opening; and one or more handles collectively affixed to the at least one basket sidewall and engageable by a capture device inserted through the inlet opening such that when drawn out of the sump by the capture device, the resilient frame flexes to facilitate removal of the basket through the inlet opening while substantially containing the collected debris within the basket floor and the at least one basket sidewall.

2. The sump insert of claim 1, wherein the filter basket further comprises a replaceable filter liner removably positioned to cover the basket floor.

3. The sump insert of claim 2, wherein the replaceable filter liner is constructed, at least in part, from a nonwoven geotextile fabric.

4. The sump insert of claim 2, wherein the basket floor and the at least one basket sidewall are constructed, at least in part, from an open weave, vinyl-encapsulated mesh fabric.

5. The sump insert of claim 1, wherein the basket floor and the at least one basket sidewall are constructed, at least in part, from a nonwoven geotextile fabric.

6. The sump insert of claim 1, wherein the sump has four sump sidewalls and the basket has four basket sidewalls, the four basket sidewalls respectively comprising four resilient members that collectively make up at least a portion of the resilient frame.

7. The sump insert of claim 6, wherein the basket floor is constructed, at least in part, from a fabric that is water-permeable and durable and has a high tensile strength and low elasticity, and wherein the four basket sidewalls are respectively constructed from four folded portions of the fabric.

8. The sump insert of claim 7, wherein the four resilient members are respectively disposed within four creases corresponding respectively to the four folded portions of the fabric.

9. The sump insert of claim 6, wherein the basket floor measures approximately 22 inches wide by 26 inches long.

10. The sump insert of claim 6, further comprising four flexible reinforcing members respectively reinforcing four sidewall joints at which pairs of the four basket sidewalls meet.

11. The sump insert of claim 10, wherein the one or more handles are collectively affixed to the four basket sidewalls via the four flexible reinforcing members.

12. The sump insert of claim 1, further comprising a float affixed to the one or more handles to facilitate engagement of the capture device with the one or more handles when the basket is submerged in water when positioned in the sump.

13. The sump insert of claim 12, wherein the float fastens together the one or more handles near their respective center portions.

14. The sump insert of claim 1, wherein the one or more handles comprise a pair of ropes.

15. The sump insert of claim 14, wherein the at least one basket sidewall includes a plurality of through-hole attachment points, through which the pair of ropes are affixed to the at least one basket sidewall.

16. The sump insert of claim 1, further comprising the capture device.

17. The sump maintenance system of claim 16, wherein the capture device comprises a pole-mounted hook.

18. The sump insert of claim 1, wherein an interior area of the basket floor is configured as a shallow, flexible concavity with respect to the upper basket opening.

* * * * *